US009142199B1

(12) United States Patent
Beletsky

(10) Patent No.: US 9,142,199 B1
(45) Date of Patent: Sep. 22, 2015

(54) LENGTH-ADJUSTABLE STRAP

(71) Applicant: Robert J. Beletsky, East New Market, MD (US)

(72) Inventor: Robert J. Beletsky, East New Market, MD (US)

( * ) Notice: Subject to any disclaimer, the term of this patent is extended or adjusted under 35 U.S.C. 154(b) by 0 days.

(21) Appl. No.: 14/677,203

(22) Filed: Apr. 2, 2015

Related U.S. Application Data

(60) Provisional application No. 61/977,289, filed on Apr. 9, 2014.

(51) Int. Cl.
*G10G 5/00* (2006.01)

(52) U.S. Cl.
CPC . *G10G 5/005* (2013.01); *G10G 5/00* (2013.01)

(58) Field of Classification Search
CPC ..... G10G 5/005; G10G 5/00
See application file for complete search history.

(56) References Cited

U.S. PATENT DOCUMENTS

| | | | | |
|---|---|---|---|---|
| 3,005,091 | A | 10/1961 | Cote | |
| 4,148,423 | A * | 4/1979 | Schlacher | 224/258 |
| 4,291,822 | A * | 9/1981 | Simonds | 224/257 |
| 4,610,476 | A * | 9/1986 | Keiner | 294/149 |
| 4,637,535 | A | 1/1987 | Aleman | |
| 4,858,801 | A * | 8/1989 | Sameniego | 224/264 |
| 4,903,874 | A | 2/1990 | Shoemaker | |
| 5,871,183 | A | 2/1999 | Milluzzi | |
| 5,936,173 | A * | 8/1999 | Tonon | 84/327 |
| 6,202,262 | B1 * | 3/2001 | Hamburger, III | 24/265 R |
| 6,626,335 | B1 * | 9/2003 | Dunlop | 224/258 |
| 6,791,018 | B2 | 9/2004 | Bazata | |
| 7,470,842 | B2 * | 12/2008 | Miller | 84/329 |
| 7,491,876 | B2 | 2/2009 | Peacock | |
| 7,507,889 | B2 * | 3/2009 | Montgomery | 84/327 |
| 8,058,540 | B2 * | 11/2011 | Furuta et al. | 84/327 |
| 8,101,840 | B1 | 1/2012 | Boulanger | |
| 2013/0068804 | A1 | 3/2013 | Tweedie | |
| 2014/0016881 | A1 | 1/2014 | Loudenslager et al. | |
| 2014/0208920 | A1 | 7/2014 | Creek | |

FOREIGN PATENT DOCUMENTS

| | | | |
|---|---|---|---|
| WO | 2009059611 | A1 | 5/2009 |

* cited by examiner

*Primary Examiner* — Robert W Horn
(74) *Attorney, Agent, or Firm* — Panitch Schwarze Belisario & Nadel LLP

(57) ABSTRACT

A length-adjustable strap has two plies joined together to form a channel therebetween. The channel generally does not extend the entire length of the strap. At least one extender slidably engages in the channel. The extender may have holes therethrough or recesses that engage elements of one or more fasteners at or near the proximal end of the strap in an adjustment region outside of the channel. Mating screws are joined to the fastener(s) to secure the extender in place. Optionally, the fastener(s) and mating screws are replaced by a tie that threads through holes formed through the first ply and optionally the second ply as well as the hole(s) formed through the extender to secure the extender in place. Multiple fastening connections more evenly distribute the load.

20 Claims, 6 Drawing Sheets

LENGTH-ADJUSTABLE STRAP

BACKGROUND

The field of the present invention relates to length-adjustable leather straps for guitars.

Guitar straps are made to hold a guitar via the shoulders at an adjustable length to suit the position favored by the musician. Guitars have different mechanisms for permitting strap attachment. Most guitars have strap nuts anchored to the guitar with screws. Generally, two strap nuts are pre-attached to electric guitars. The lower strap nut usually is located at the bottom (bridge end) of the guitar body. The upper strap nut usually is located at or near the top (neck end) of the guitar body, such as on the upper body curve, at the tip of the upper horn on a double cut-away, or at the neck joint (heel), or sometimes at the lower body end. Some acoustic and classical guitars have only a single strap nut at the bottom of the body. The other end must be tied onto the headstock, above the nut and below the machine heads.

While some guitar straps are formed with lengths of fabric and have protruding buckles at one or both ends for length adjustment, most professional musicians favor leather guitar straps, and particularly those with ladder lock or "H" lock attachment. For leather straps with ladder lock attachment, the strap has a series of slots at each end. A separate length leather strap having a width comparable to the slot opening is provided with one end having a clasp or hole therein. Once a desired guitar strap length is determined, the separate length leather strap is threaded through the slots above and below the face surfaces of the main strap. The separate length leather strap also is threaded through the clasp or hole to engage the leather strap in place. The separate length of the leather strap is provided with one or more openings to engage strap buttons.

One disadvantage of existing leather guitar straps with ladder lock attachment is that length adjustment cannot be completed rapidly. Moreover, it is not intuitive how best to adjust for a desired length. The separate length leather strap has to be removed and repositioned and re-threaded through the slots of the main strap. A third disadvantage of existing leather guitar straps is that the separate length leather strap has portions seated on each face surface of the guitar strap. These raised portions increase the thickness of the guitar strap, make the outer faces of the strap not smooth, and tend to rub against the user's shoulder or back causing discomfort.

U.S. Pat. No. 7,507,889 shows a compression adjustable strap that has a first portion defining a tunnel along substantially the entire length of the first portion to slidingly receive a second strap portion. The compression or frictional engagement between the first strap portion and second strap portion is sufficient to secure the position of the second strap portion. Optionally, the second strap portion may define a row of holes to engage with a post or button on the first portion to maintain the second strap portion in a desired position with respect to the first portion (which the patent calls an "adjustment keeper"). The compression adjustable strap may be used as a guitar strap.

U.S. Pat. No. 4,858,801 discloses a guitar strap that is a band with an end belt coupled to one side of the band by slidably inserting the end belt into a tunnel. The anchor member to hold the end belt to the band may be a hook and loop fastener. One fastener strip is on the external face of the band.

A disadvantage of existing guitar straps with tunnels to hold extenders is that compression or frictional engagement is not sufficient to maintain the position of the slidable portion in a tunnel. A single hole seated over a single point post or button used as an "adjustment keeper" forms an early failure zone for the strap, shortening the useful life of the strap. A second disadvantage is that hook and loop fasteners increase the thickness of the guitar strap and lead to surface wear or cause bulges to form on the strap leading to user discomfort.

Improvements to length adjustable leather straps for guitars continue to be sought. Golf bags and rifle carry slings also would benefit from unencumbered, smooth-surfaced length-adjustable leather straps.

SUMMARY

In one aspect of the invention, a length-adjustable strap has a first ply joined to a second ply and defining a channel between the first ply and the second ply. A fastener is positioned at or near the proximal end of the first ply. An extender is slidably engageable into the channel from the proximal end of the first ply. The extender defines a plurality of spaced apart holes therethrough or recesses. Each of said holes or recesses is adapted to mate with an element of the fastener, such as an internally threaded opening or an upstanding threaded post. Preferably, the holes or recesses are aligned such that a respective hole of the extender is matched with a respective element of the fastener. Such holes then may engage the respective elements of the fastener to set the length of that portion of the extender that extends out from the channel. In one embodiment, the fastener has one element to engage with a respective hole of the extender, and in another embodiment, the fastener has more than one element to engage, with each element adapted to engage with a respective hole of the extender. The fastener is in an adjustment region that is in a nonencumbered area of the strap outside of the channel.

A hole closer to the proximal end of the extender is adapted to engage a guitar nut. Mating screws may engage or mate with the elements of the fasteners to secure the extender in place.

In a second aspect of the invention, a fastener is positioned at or near the proximal end of the first ply and the fastener has elements disposed in a line that is parallel to the center line along the length of the strap. The extender defines a plurality of spaced apart holes or recesses that are disposed in a single row extending in a line that is parallel to the center line along the length of the extender. Two of such holes or recesses may engage the elements of the fastener to set the length of that portion of the extender that extends out from the channel. The fastener is in an adjustment region that is in a nonencumbered area of the strap outside of the channel.

In another aspect of the invention, the length-adjustable strap has a second fastener or pair of fasteners at or near the distal end of the first ply. A second extender is slidably engageable into the channel, so that the first extender extends from one end and the second extender extends from the other end of the strap. The second extender defines a plurality of spaced apart holes therethrough or recesses, with said holes or recesses adapted to mate with the second fastener or pair of fasteners. Additional mating screws may engage or mate with the second fastener(s) to secure the second extender in place.

In another aspect of the invention, the first ply defines first and second slot openings at or near its proximal end and its distal end, respectively. The extender(s) slidably engage into the channel via the first and second slot openings.

In still another aspect of the invention, the length-adjustable strap has a first ply joined to a second ply to define a channel therebetween. However, fastener(s) are not joined to the strap. Instead, the first ply and optionally the second ply further define two or more holes therethrough at or near the proximal end, and optionally two or more additional holes therethrough at or near the distal end. An extender is slidably engageable into the channel. The extender defines a plurality of holes along at least a portion of its length. A tie is threaded through at least some of the holes through the first ply and the holes through the extender to join the extender to the first ply. If the second ply has holes therethrough, the tie may be threaded also through those holes so that the extender is joined to the first ply and the second ply. The holes may be disposed in either one row or in two rows along the length of the extender. The tie is threaded through at least two of the holes, such as two of the holes in the single row where the extender has a single row of holes, or such as one hole from each row in the two rows where the extender has two rows of holes. The holes through the first ply are in an adjustment region that is in a nonencumbered area of the strap outside of the channel.

The length-adjustable straps have particular application for attachment to a nut projecting outwardly from a guitar. The extenders have holes, slots, openings or engagement mechanisms adapted to attach to the nut on a guitar.

There are several advantages of the length-adjustable straps of the current invention for guitar straps. The length-adjustment is made in an adjustment region, which is a free-floating area that is not in contact with the guitar body or the user's shoulder. The extender does not increase bulk or encumber the shoulder-contacting area of the user. The second ply of the length-adjustable strap has a surface facing away from the first ply that is substantially smooth. This substantially smooth surface allows the strap to slide along the user's shoulder without encumbering the shoulder or having raised portions or bulges that rub the user's shoulder. In addition, the substantially smooth surface won't scuff or mar guitar surfaces. Moreover, the length adjustment is more intuitive because the holes in the extender are spaced apart at uniform spacing distances and are engageable with elements of fasteners or with holes in the first/second ply that are spaced apart at the same uniform spacing distances. This design is particularly advantageous when the first ply and second ply are formed of leather.

The length-adjustable straps also can be used in association with Sunday golf bags and rifle carry slings, among other things.

A more complete understanding of the invention, including an understanding of the various configurations of length-adjustable straps, will be afforded to those skilled in the art, as well as a realization of additional advantages and objects thereof, by consideration of the followed detailed description. Reference will be made to the appended drawing sheets which will first be described briefly.

BRIEF DESCRIPTION OF THE DRAWINGS

The drawings described herein are for illustrative purposes only and are not intended to limit the scope of the present disclosure. In the drawings, wherein like reference numerals refer to similar components.

DETAILED DESCRIPTION

Figures 1, 2, 3:
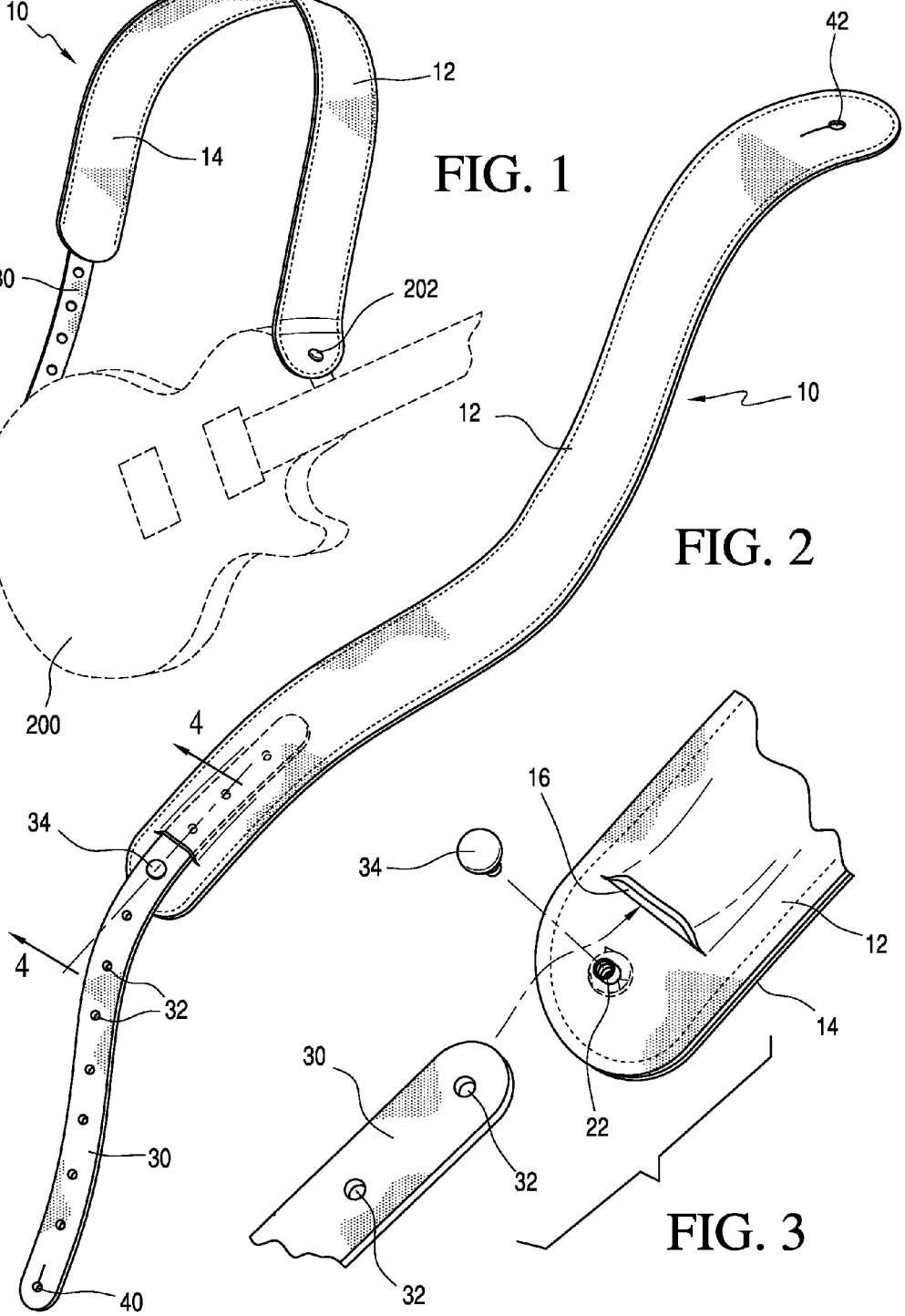
FIG. 1 is a right front perspective view of a first embodiment of a length-adjustable strap according to the invention shown attached to a guitar.
FIG. 2 is a right front perspective view of the first embodiment of a length-adjustable strap according to the invention.
FIG. 3 is a partial exploded view of a proximal end of the length adjustable strap of FIG. 2.
Figure 4:
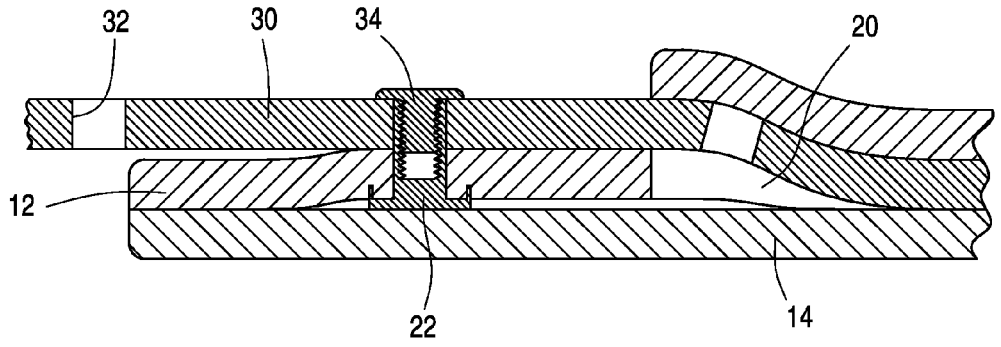
FIG. 4 is a partial right front perspective view of the proximal end of the length adjustable strap of FIG. 1 as assembled.

Turning in detail to the drawings, FIGS. 1-4 show a first embodiment of a length-adjustable strap 10. The strap 10 may be a guitar strap. The strap 10 is shown attached to a guitar 200 in FIG. 1. One end of an extender 30 is joined to a guitar nut (not shown), and one end of the strap 10 is joined to another guitar nut 202.

The strap 10 has an upper ply or first ply 12 joined to a lower ply or second ply 14. Preferably, the two plies 12, 14 are leather. A central channel 20 is formed between the facing surfaces of the upper ply 12 and the lower ply 14. The upper ply 12 defines a slot opening 16 that communicates with the central channel 20. The central channel 20 preferably does not extend along the entire length of the strap 10.

A first upstanding threaded screw, t-nut or PAL nut 22 is provided at or near the proximal end of the upper ply 12 and extends outwardly from the outer face surface of the upper ply 12. The first upstanding threaded screw or nut 22 in this embodiment is positioned adjacent to the slot opening 16 leading to the channel 20.

A first extender 30 has a width suitable for slidable engagement through the slot 16 and into the channel 20 at the proximal end of the strap 10. The first extender 30 has a plurality of holes 32 therethrough or recesses extending along its length. A first end of the first extender 30 is inserted into the channel 20 through the slot 16. A portion of the length of the first extender 30 remains extended outside of the channel 20. The first upstanding threaded screw, t-nut or PAL nut 22 mates with one of the holes 32 to establish a desired length of the extender outside of the channel 20. A mating screw 34 is joined to the first upstanding threaded screw, t-nut or PAL nut 22 to fasten the screws together and join the extender 30 to the first ply 12 of the strap 10.

Optionally, a second extender (not shown) has a width suitable for slidable engagement through an opposite slot and into the channel 20 at the distal end of the strap 10. A first end of the second extender is inserted into the channel 20 through the opposite slot. A portion of the length of the second extender remains extended outside of the channel 20. The second extender may have a plurality of holes therethrough or recesses extending along its length. A second upstanding threaded screw, t-nut or PAL nut mates with one of the holes to establish a desired length of the optional second extender outside of the channel 20. A second mating screw is joined to the second upstanding threaded screw, t-nut or PAL nut to fasten the screws together and join the second extender to the first ply 12 of the strap 10.

A significant advantage of this second embodiment of the length-adjustable strap 10 is that the outwardly facing surface of the second ply 14 remains smooth, without raised portions that may scuff or mar equipment surfaces. A second significant advantage is that the extender(s) 30 are readily adjusted very quickly to have different length portions exposed outside of the channel 20. The strap need not be separated from the equipment to which it is attached, such as a guitar, when the positions of the extender(s) is/are adjusted to lengthen or shorten the overall length of the length-adjustable strap.

Figure 5:
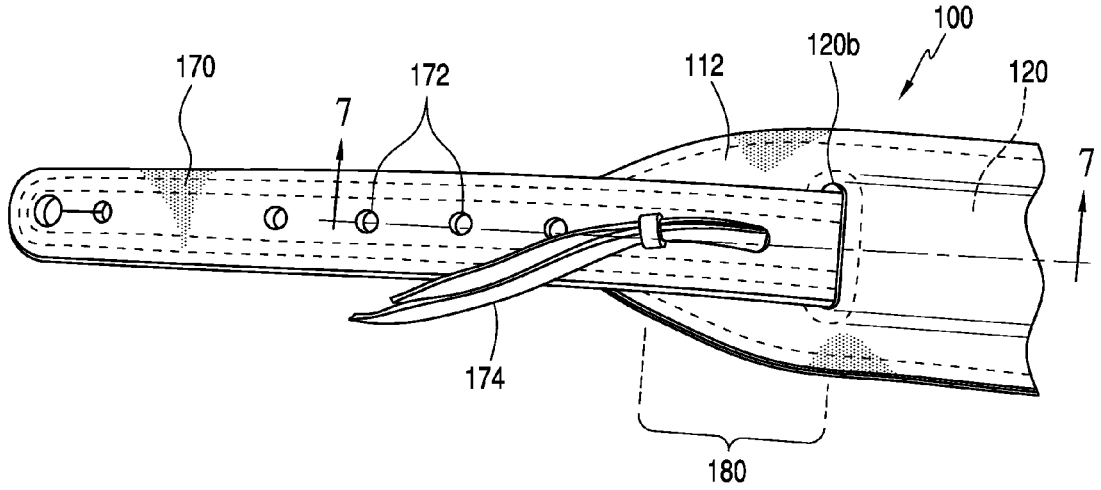
FIG. 5 is a top plan view of a second embodiment of a length-adjustable strap according to the invention.
Figure 6:
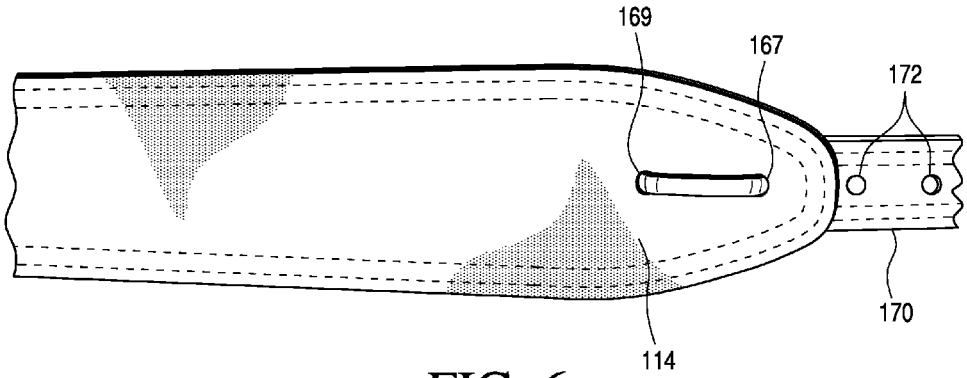
FIG. 6 is a bottom plan view of the length-adjustable strap of FIG. 6.
Figure 7:
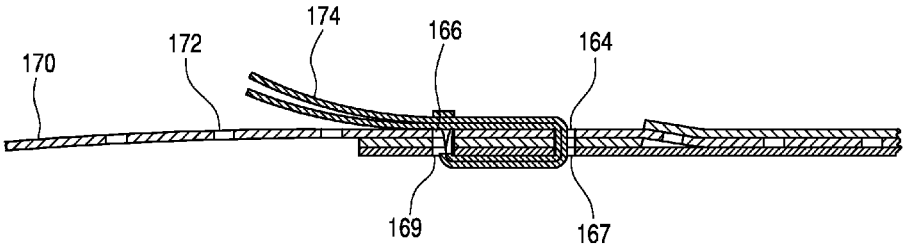
FIG. 7 is a cross-sectional view taken along line 7-7 of FIG. 6.
Figure 8:
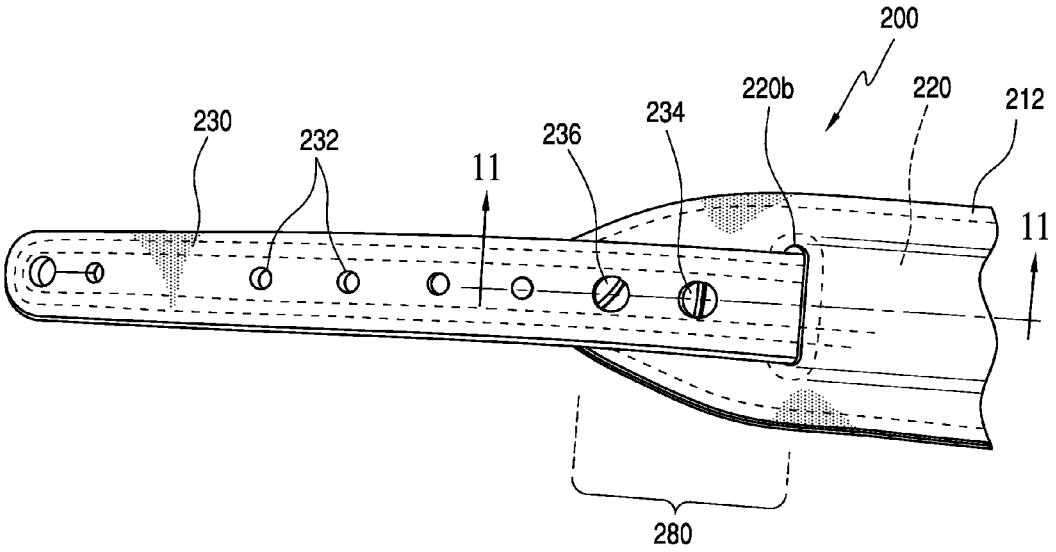
FIG. 8 is a top plan view of a third embodiment of a length-adjustable strap according to the invention.
Figure 9:
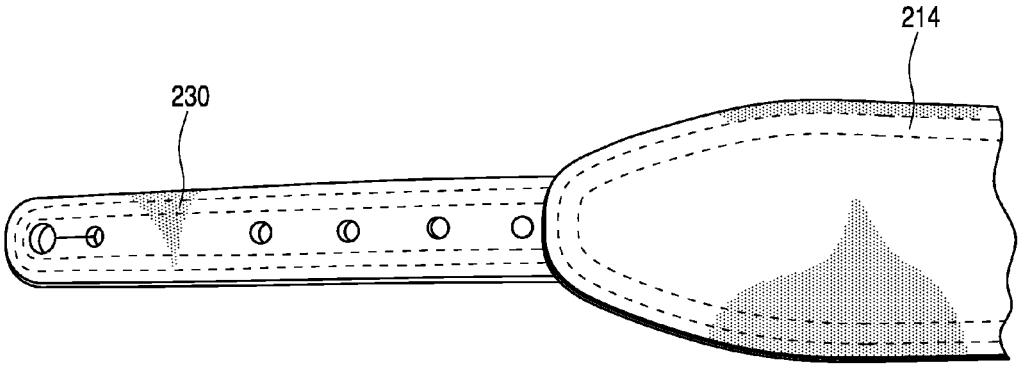
FIG. 9 is a bottom plan view of the length adjustable strap of FIG. 8.
Figure 10:
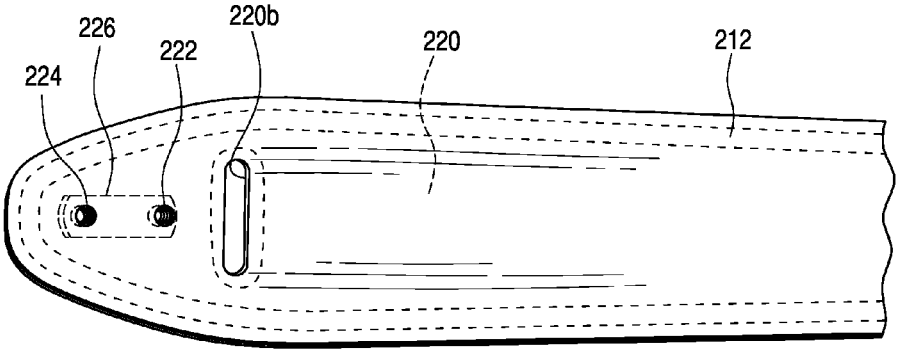
FIG. 10 is a top plan view of the first ply portion of the length-adjustable strap of FIG. 8 without an extender.
Figure 11:
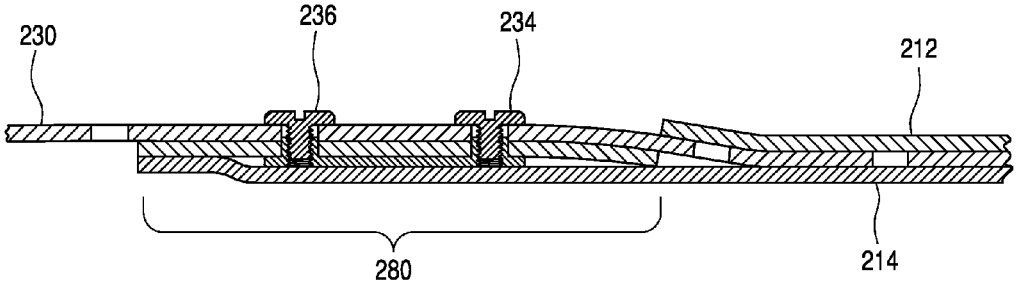
FIG. 11 is a cross-sectional view taken along line 11-11 of FIG. 8.

Referring next to FIGS. 5 to 7, an alternative embodiment of the length-adjustable strap 100 has an upper ply or first ply 112 joined to a lower ply or second ply 114. Preferably, the two plies 112, 114 are leather. A central channel 120 is formed between the facing surfaces of the upper ply 112 and the lower ply 114. The upper ply 112 defines a slot opening 120*b* that communicates with the central channel 120.

A pair of holes 164, 166 is formed through the first ply 112. The holes 164, 166 are spaced apart in a line along a center axis of the first ply along its length. The holes 164, 166 are generally near the proximal end of the strap in the adjustment region 180. A pair of holes 167, 169 is formed through the second ply 114. The holes 167, 169 are spaced apart in a line along a center axis of the second ply along its length. The holes 167, 169 substantially align with holes 164, 166.

A first extender 170 shown in FIGS. 5 to 7 has a row of holes 172 therethrough along its length. As shown in FIG. 6, the holes 172 extend in a row along the center axis along the length of the extender 170. A raw hide string or other tie 174 is threaded through a first hole of the row of holes in the extender 170, and through the hole 164 formed in the first ply 112, and through the hole 167 formed in the second ply 114, then the tie 174 is threaded through a second hole 169 in the second ply 114 and through the second hole 166 in the first ply 112. The ends of the string or tie 174 are then tied or knotted together to join the extender 170 to the first ply 112 and second ply 114.

The central channel 120 preferably does not extend along the entire length of the strap 100. Preferably, the central channel 120 does not extend more than about 20 inches from the proximal end of the strap. With such preferred embodiment, the user's shoulder comes into contact with only the second ply 114 of the strap 100 without the bulk of the extender 170 inside the strap. The entire width of strap 100 then lays on the user's shoulder as intended without bulging and without otherwise encumbering the user. I have found that there is improved comfort for the user if there are no encumbrances to the strap for from two-thirds to three-fourths of the guitar strap. Thus, it is preferred that the extender (170) does not extend into the central channel 120 beyond about one-fourth to one-third the length of the guitar strap. Hence, there is less bulk along that portion of the strap 100 that is in contact with a user's shoulder.

A significant advantage of this embodiment of the length-adjustable strap 100 is that the outwardly facing surface of the second ply 114 remains relatively smooth, either without raised portions that may scuff or mar equipment surfaces, or with only leather tie at the outwardly facing surface, which does not scuff or mar equipment surfaces. A second significant advantage is that the slidably engageable extender(s) 170 are readily adjusted very quickly at the adjustment region 180 to have different length portions exposed outside of the channel 120. The strap need not be separated from the equipment to which it is attached, such as a guitar, when the positions of the extender(s) is/are adjusted to lengthen or shorten the overall length of the length-adjustable strap. The length adjustment in the adjustment region 180 is made in a free-floating area spaced apart from the guitar and from that part of the strap that rests on the user's shoulder. A third significant advantage is that the extender is secured to the first and second plies at two points of connection to better distribute the load on the tie 174.

Referring next to FIGS. 8 to 11, an alternative embodiment of the length-adjustable strap 200 has an upper ply or first ply 212 joined to a lower ply or second ply 214. Preferably, the two plies 212, 214 are leather. A central channel 220 is formed between the facing surfaces of the upper ply 212 and the lower ply 214. The upper ply 212 defines a slot opening 220*b* that communicates with the central channel 220. The central channel 220 preferably does not extend along the entire length of the strap 200. Hence, there is less bulk along that portion of the strap 200 that is in contact with a user's shoulder.

A fastener 226, such as a double t-nut fastener, is embedded between the first and second plies 212, 214. A first internally threaded portion 222 is provided in the fastener 226 at or near the proximal end of the upper ply 212 and is accessed through a hole formed in the outer face surface of the upper ply 212. The first internally threaded portion 222 in this embodiment is positioned adjacent to the slot opening 220*b* leading to the channel 220. A second internally threaded portion 224 is provided in the fastener 226 and is spaced apart from the first threaded portion 222, preferably along a center line of the upper ply 212. The second internally threaded portion 224 is accessed through a hole formed in the outer face surface of the upper ply 212. The fastener 226 is located in the adjustment region 280 that is between the proximal end of the first ply 212 and the slot opening 220*b* of the channel 220.

A first extender 230 has a width suitable for slidable engagement through the slot 220*b* and into the channel 220 at the proximal end of the strap 200. The first extender 230 has a plurality of holes 232 therethrough or recesses extending along its length. A first end of the first extender 230 is inserted into the channel 220 through the slot 220*b*. A portion of the length of the first extender 230 remains extended outside of the channel 220. Holes 232 of the first extender 230 are matched with the holes in the upper ply 212 to access the internally threaded portions 222, 224 of the fastener 226 to establish a desired length of the extender outside of the channel 220. A mating screw, t-nut or PAL nut 234 is joined to the first internally threaded portion 222 to fasten the screw to the fastener 226 and join the extender 230 to the first ply 212 of the strap 200. A second mating screw 236 is joined to the internally threaded portion 224 of the fastener 226 to fasten the screw to the fastener and join the extender 230 to the first ply 221 of the strap 200.

A significant advantage of this embodiment of the length-adjustable strap 200 is that the outwardly facing surface of the second ply 214 remains smooth, without raised portions that may scuff or mar equipment surfaces. A second significant advantage is that the slidably engageable extender(s) 230 are readily adjusted very quickly to have different length portions exposed outside of the channel 220. The strap need not be separated from the equipment to which it is attached, such as a guitar, when the positions of the extender(s) is/are adjusted to lengthen or shorten the overall length of the length-adjustable strap. The length adjustment occurs at the adjustment region 280 which is outside of the channel 220 and is in a free-floating region of the strap that is not in contact with the guitar or with the user's shoulder when the strap is worn. A third significant advantage is that the extender is secured to the first and second plies at two points of connection to better distribute the load on each fastener. Moreover, it is again desired to have the length of the extender 230 be limited to about one-fourth to one-third the length of the guitar strap to minimize bulk in the majority of the length of the guitar strap for increased user comfort.

Figure 12:
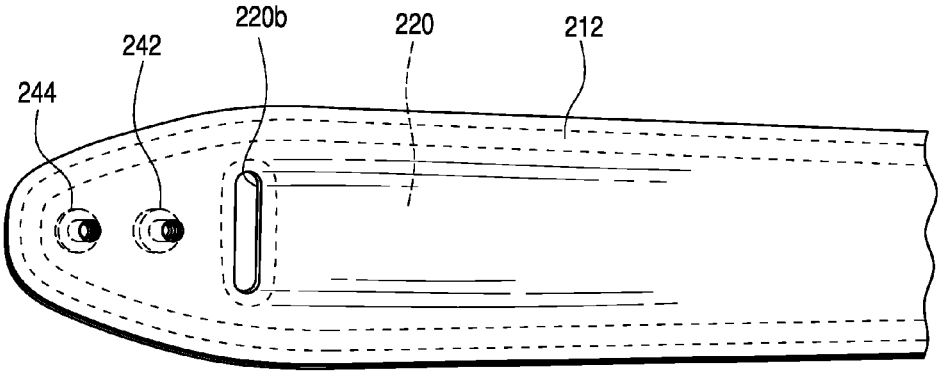
FIG. 12 is a top plan view of the first ply portion of a fourth embodiment of a length-adjustable strap according to the invention without an extender.
Figure 13:
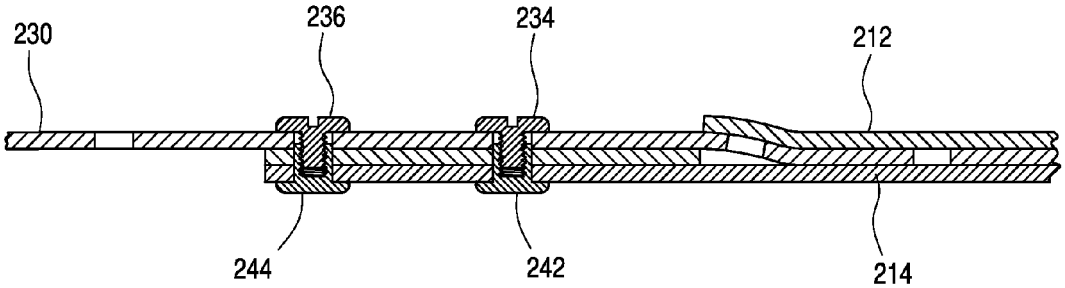
FIG. 13 is a cross-sectional view of a length-adjustable strap with an extender joined by customary screw fasteners.

An alternative arrangement is shown in FIGS. 12 and 13. Instead of fastener 226 that is present in the embodiment of FIGS. 8-11, it would be possible to use more customary fastening hardware, such as mating screws, t-nuts or PAL nuts 242, 244 to receiving mating screws 234, 236. In such an embodiment, the screw heads of the mating screws, t-nuts or PAL nuts 242, 244 would be visible at the outer surface of the lower ply 214. In such case, it may be more desirable to have plastic screw heads so as to minimize scratching or marring of guitars or other instruments or equipment connected to the strap. The holes 232 in the extender 230 seat around the upstanding portions of the mating screws, t-nuts of PAL nuts 242, 244. Then mating fasteners 234, 236 are joined to secure the extender to the first ply 212 of the strap 200.

Optionally, if the channel 220 extends along the entire length of the strap, a second extender (not shown) has a width suitable for slidable engagement through an opposite slot and into the channel 220 at the distal end of the strap 200. A first end of the second extender is inserted into the channel 220 through the opposite slot. A portion of the length of the second extender remains extended outside of the channel 220. The second extender may have a plurality of holes therethrough or recesses extending along its length. A second double fastener comparable to fastener 226 is embedded between the plies 212, 214 (or customary fasteners 242, 244 are provided). Once the holes of the optional second extender are aligned with the fastening elements of the double fastener to establish a desired length of the optional second extender outside of the channel 220, mating screws may be joined to receiving elements of the double fastener to join the second extender to the first ply 212 of the strap 200.

Adjusting the length of the guitar straps 10, 100, 200 of the invention can be accomplished quickly and accurately. The joining mechanisms are easy for a user to detach and reattach when extending a greater or lesser portion of the length of the extenders 70, 170, 230 out of the central channels 20, 120, 220. Preferably, the spacing between holes 172, 232 of the extenders is consistent, such as one-inch from the center of a first hole to the center of an adjacent hole, and so on. The extenders 70, 170, 230 preferably may have a length from end to end of between about 12 inches and about 20 inches, most preferably about 18 inches.

Thus, various configurations of length-adjustable straps are disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A length-adjustable strap, comprising:

a first ply having a length, and having a proximal end and a distal end;

a second ply having a length substantially the same as the length of the first ply, said second ply joined to the first ply and defining a channel between the first ply and the second ply;

a fastener at or near the proximal end of the first ply; and an extender having a length and having a proximal end and a distal end, said extender defining a plurality of spaced apart holes therethrough or recesses, with at least one of said holes or recesses adapted to mate with the fastener, wherein said extender is slidably engageable into the channel and wherein the extender is fastened to the first ply solely in an adjustment region at or near the proximal end of the first ply and outside of the channel.

2. The length-adjustable strap of claim 1, further comprising a mating screw that mates with the fastener.

3. The length-adjustable strap of claim 1, wherein the fastener has at least two spaced-apart elements, and each spaced-apart element matches with a respective one of the spaced apart holes through the extender.

4. The length-adjustable strap of claim 3, further comprising mating screws, wherein each mating screw mates with a respective one of the spaced apart elements of the fastener.

5. The length-adjustable strap of claim 1, further comprising:

a second fastener at or near the r the distal end of the first ply; and a second extender having a length and having a proximal end and a distal end, said second extender defining a plurality of spaced apart holes therethrough or recesses, with at least one of said holes or recesses adapted to mate with the second fastener, wherein said second extender is slidably engageable into the channel.

6. The length-adjustable strap of claim 5, further comprising a second mating screw that mates with the second fastener.

7. The length-adjustable strap of claim 1, wherein the first ply defines a first slot opening at or near its proximal end, and the extender slidably engages into the channel via the first slot opening.

8. The length-adjustable strap of claim 7, wherein the fastener is at or near the proximal end of the first ply and the slot is spaced apart from the proximal end of the first ply.

9. The length-adjustable strap of claim 7, further comprising:

a second fastener at or near the distal end of the first ply; and a second extender having a length and having a proximal end and a distal end, said second extender defining a plurality of spaced apart holes or recesses therethrough, with at least one of said holes or recesses adapted to mate with the second fastener, and wherein the first ply defines a second slot opening at or near its distal end and the second extender slidably engages into the channel via the second slot opening.

10. The length-adjustable strap of claim 9, wherein the second fastener is spaced apart from the distal end of the first ply.

11. The length adjustable strap of claim 1, wherein the second ply has a surface facing the first ply and a surface facing away from the first ply, and the surface facing away from the first ply is substantially smooth.

12. The length-adjustable strap of claim 1, wherein the distal end of the extender defines a hole or engagement mechanism for engaging with a nut on a guitar.

13. The length-adjustable strap of claim 1, wherein the first ply and the second ply are formed of leather.

14. A length-adjustable strap, comprising:

a first ply having a length, and having a proximal end and a distal end, said first ply defining two or more holes therethrough at or near the proximal end;

a second ply having a length substantially the same as the length of the first ply, said second ply joined to the first ply and defining a channel between the first ply and the second ply;

an extender having a length and having a proximal end and a distal end, said extender defining a plurality of spaced apart holes therethrough, wherein said extender is slidably engageable into the channel; and a tie having a length that is threaded through at least some of the holes through the first ply and the holes through the extender to join the extender to the first ply;

wherein the extender is fastened to the first ply with the tie solely in an adjustment region at or near the proximal end of the first ply and outside of the channel.

15. The length-adjustable strap of claim 14, further comprising:

a second extender having a length and having a proximal end and a distal end, said second extender defining a plurality of spaced apart holes therethrough or recesses, wherein said second extender is slidably engageable into the channel; and a second tie having a length that is threaded through at least some of the holes through the first ply and the holes through the second extender to join the second extender to the first ply.

16. The length-adjustable strap of claim 14, wherein the second ply defines two or more holes at or near its proximal end adapted for receiving the tie to join the extender also to the second ply.

17. The length-adjustable strap of claim 15, wherein the second ply defines two or more holes at or near its distal end adapted for receiving the second tie to join the second extender also to the second ply.

18. The length-adjustable strap of claim 14, wherein the distal end of the extender defines a hole or engagement mechanism adapted for engaging with a nut on a guitar.

19. The length-adjustable strap of claim 15, wherein the distal end of the second extender defines a hole or engagement mechanism adapted for engaging with a nut on a guitar.

20. The length-adjustable strap of claim 14, wherein the first ply and second ply are formed of leather.

* * * * *